US007751575B1

(12) United States Patent
Baumhauer, Jr. et al.

(10) Patent No.: US 7,751,575 B1
(45) Date of Patent: Jul. 6, 2010

(54) MICROPHONE SYSTEM FOR COMMUNICATION DEVICES

(76) Inventors: John C. Baumhauer, Jr., 6270 Harbridge Rd., Indianapolis, IN (US) 46220; Larry A. Marcus, 9941 Logan La., Fishers, IN (US) 46038; Christopher T. Welsh, 11645 River Ridge Dr., Fishers, IN (US) 46038; Alan D. Michel, 7581 Sloop Cir., Fishers, IN (US) 46038; Jeffrey Phillip McAteer, 12915 Fawns Ridge, Fishers, IN (US) 46038

( * ) Notice: Subject to any disclaimer, the term of this patent is extended or adjusted under 35 U.S.C. 154(b) by 1011 days.

(21) Appl. No.: 10/670,899

(22) Filed: Sep. 25, 2003

Related U.S. Application Data

(60) Provisional application No. 60/413,274, filed on Sep. 25, 2002.

(51) Int. Cl.
*H04R 3/00* (2006.01)

(52) U.S. Cl. ..... 381/92

(58) Field of Classification Search ..... 381/92, 381/94.1, 98, 103, 71.11–71.12; 455/63.1, 455/67.13, 295–296, 570
See application file for complete search history.

(56) References Cited

U.S. PATENT DOCUMENTS 4,672,674 A * 6/1987 Clough et al. ..... 381/94.7
5,029,215 A * 7/1991 Miller, II ..... 381/58
5,303,307 A 4/1994 Elko et al.
5,471,538 A * 11/1995 Sasaki et al. ..... 381/92
5,473,701 A * 12/1995 Cezanne et al. ..... 381/92
5,506,908 A 4/1996 Baumhauer, Jr. et al.
5,625,684 A * 4/1997 Matouk et al. ..... 379/392.01
5,797,852 A * 8/1998 Karakasoglu et al. ..... 600/529
6,275,592 B1 * 8/2001 Vartiainen ..... 381/71.11
7,146,013 B1 * 12/2006 Saito et al. ..... 381/92
7,242,781 B2 * 7/2007 Hou ..... 381/92

* cited by examiner

*Primary Examiner*—Vivian Chin
*Assistant Examiner*—Lun-See Lao
(74) *Attorney, Agent, or Firm*—Alexander D. Forman; Ice Miller LLP

(57) ABSTRACT

The microphone system for communication devices that comprises an electric circuit comprising two microphone elements connected to a signal flow processor. This processor uses a digital signal processor or comparable analog circuitry to provide a particular electrical time delay (τ) to one of the microphone elements (nearest the ear or loudspeaker) and a compatible amplitude gain (Gm1) to the other microphone element (nearest the user's mouth) in order to substantially reduce the external acoustic coupling and echo of communication devices in the receive and doubletalk state. Further, this processing system allows the microphone system to reduce the pickup of ambient noise in the send and idle state, while still being sensitive to the user's speech.

15 Claims, 6 Drawing Sheets

MICROPHONE SYSTEM FOR COMMUNICATION DEVICES

CROSS-REFERENCE TO RELATED APPLICATIONS

This application claims the benefit of U.S. Provisional Application No. 60/413,274, filed Sep. 25, 2002.

BACKGROUND OF THE INVENTION

Modern mobile phones, also referred to as cellular phones, have become widely used as a mode of communication for the general public throughout the world. One goal of mobile phone manufacturers has been to create a phone that can be easily carried on a person's body. Consequently, the design of mobile phones have constantly been improved upon to reduce the overall size and weight of the mobile phone. While these improvements have created a small, compact phone that can easily be carried on a person's body, they have also created acoustical problems that have detracted from the phone's audio functionality.

One of the largest problems incurred by users of mobile phones is the acoustic echo that occurs when users have a phone conversation. Modern cellular phones and some other types of telephone 'handsets' make a poor seal to a user's outer ear due to the small physical size of the handset's earpiece. Thus, when a conversation takes place on the phone, the speech signals received by the phone's receiver (referred to as the "receive speech") leaks out of the adjacent ear cavity, about the ear pinna, into the room. Once the receive speech leaks out of the ear cavity (referred to as an "ear leak"), it will radiate through the air and reach the microphone input sound port(s) of the mobile phone, which then causes the far-end talker (the person on the other end of the line, also referred to as the far-end person) to hear a delayed, acoustic "echo" of their own speech. The pickup of this radiated echo by the mobile phone's microphone is called external acoustic coupling. This problem persists during the times the mobile phone is receiving speech, the so called "receive" state, and during the "doubletalk" state (when both user and the far-end talker simultaneously speak). As designers make mobile phones smaller, the microphone-to-ear distance becomes smaller and the microphone-to-user's mouth distance becomes greater. Both of these changes in distances have caused the echo pickup by the microphones to occur more frequently and severely. Accordingly, the echo heard by a far-end talker, via external acoustic coupling, has become the number one sound quality design problem in mobile phone designs.

Another problem incurred by users of mobile phones is the ambient/background noise that can reach the microphone input sound port(s) of the mobile phone and interfere with the ability of a far-end person to hear the user of the mobile phone when the user speaks. The smaller the mobile phone, the greater the distance becomes between a user's mouth and the microphone input sound port(s) of the phone. As this distance increases, more electronic amplification must be applied to the user's talking signal (referred to as "send" speech) because the speech level entering the sound port(s) is reduced. Unfortunately, this amplification subsequently raises the signal level associated with the ambient noise that enters the microphone port(s). Thus, in the send and idle (quiet) states, the dominant problem is the ambient noise that leaks into the microphone system and interferes with the far-end person's ability to listen to the speech of the user of the mobile phone.

Similar problems exist in other communication devices, including but not limited to, hands-free "speakerphones" that are used in automobiles and conference rooms. For example, in a hands-free speakerphone in a conference room, the receiving loudspeaker is typically positioned in close proximity to the microphone input sound ports of the phone. Thus, just as in a mobile phone, the receive speech will radiate through the air and reach the microphone input sound ports, which can cause the far-end talker to hear a delayed, acoustic echo of themselves. Further, the distance between a user's mouth and the microphone system of the speakerphone is great and electric amplification of the send speech is required. Thus, similar to the mobile phone, a speakerphone requires amplification of the send speech, which in turn amplifies the ambient noise picked up by the microphone system. This amplification of the ambient noise interferes with the far-end person's ability to listen to the user of the speakerphone.

Accordingly, it is desired to provide a microphone system for communication devices that greatly reduces the external acoustic coupling of any type of communication device. Further, it is desired to provide a microphone system for communication devices that attenuates the pickup of ambient noise by the microphone system while still being sensitive to the user's speech.

SUMMARY OF THE INVENTION

In one embodiment, the microphone system for communication devices utilizes a signal flow processor that is electrically connected to a first microphone element and a second microphone element. The signal flow processor provides an electrical time delay to the first microphone element and a compatible amplitude gain to the second microphone element. After the electrical time delay and compatible amplitude gain are applied, the signal flow processor subtracts the outputs of the first and second microphone elements to create a null that reduces external acoustic coupling. The first microphone element, with time delay, should be closest to the direction of the null. The microphone elements can each comprise an omnidirectional microphone element.

The microphone elements can be installed in any type of communication device with an acoustical driver (as used herein, the term "acoustical driver" means a receiver for a handset or headset communication device or a loudspeaker for a speakerphone or other hands-free communication device). For example, the microphone elements can be installed in a mobile phone or a speakerphone so that separate and distinct microphone input sound ports will lead into each of the microphone elements, respectively.

The electrical time delay can be calculated based on the dimensions of the communications device which houses the microphone system. The electrical time delay will be equal to $(w-u)/c$ with the variable w equaling the distance between the acoustical driver (i.e., a receiver and/or loudspeaker) of the communication device and the second sound port that leads into the second microphone element. The variable c equals the speed of sound and the variable u equals $\sqrt{[w^2+d_2^2-2\,d_2\,w\cos(\kappa-\Psi)]}$. The variable $d_2$ is equal to the distance between the first and second input sound ports, the variable $\Psi$ is equal to the angle of the second input sound port and the first input sound port, and the variable $\kappa$ is equal to the angle of the second input port and the ear reference point adjacent to a phone's receiver or the center of the loudspeaker. Based on these definitions of the variables, the compatible amplitude gain will be equal to $(w/u)$. Alternatively, the electrical time delay and compatible amplitude gain can be determined by driving either the receiver or loudspeaker of the communication device with an impulse and measuring the impulse responses at both the locations of the first and second microphone element outputs.

DETAILED DESCRIPTION OF THE INVENTION

Figure 1:
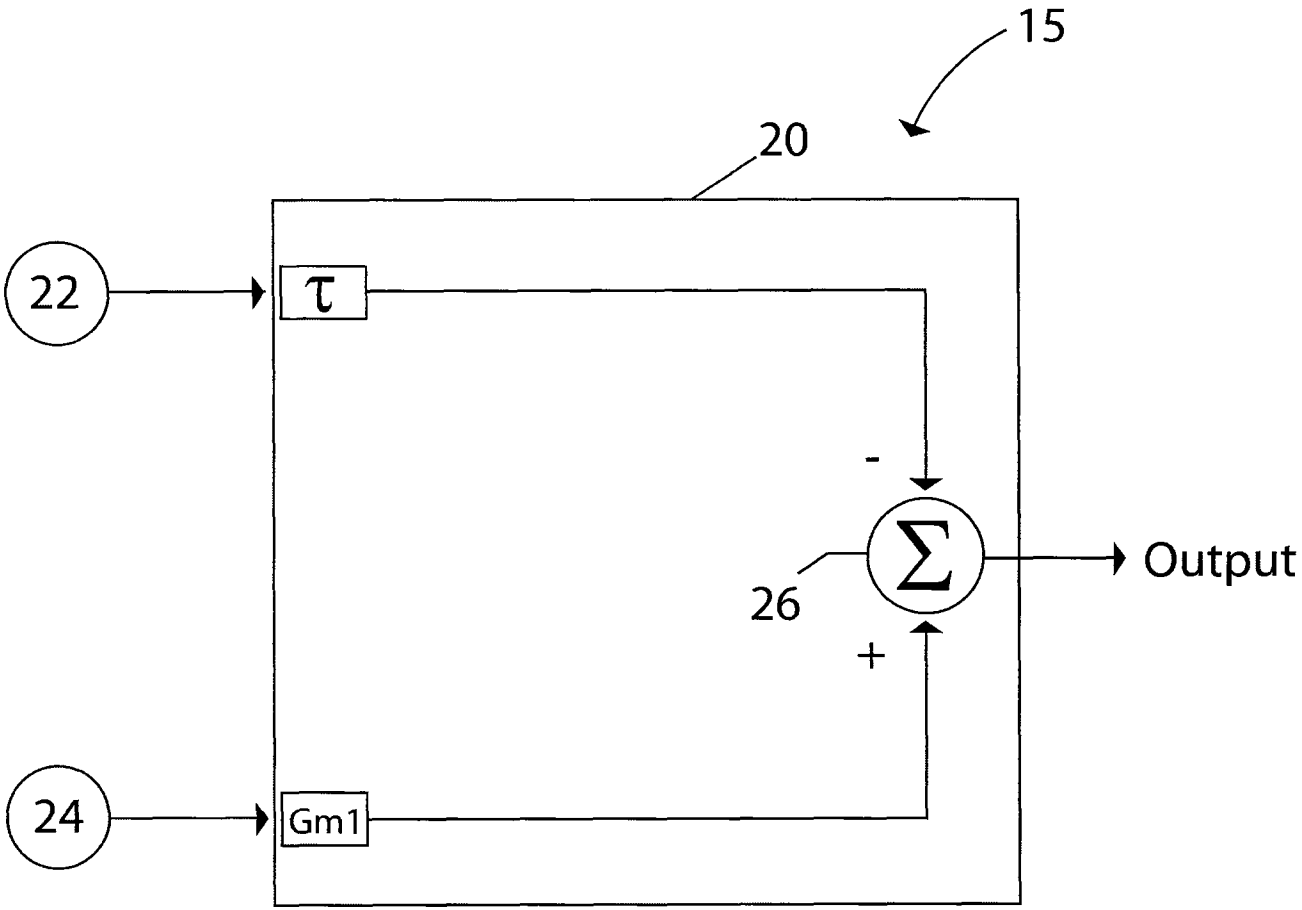
FIG. 1 shows an exemplary embodiment of the microphone system.

FIG. 1 shows an exemplary embodiment of a microphone system for communication devices. As shown in FIG. 1, the microphone system comprises a first-order gradient microphone system 15 with a signal flow processor 20 electrically connected to two microphone elements 22 and 24 that eventually undergo a subtraction 26. Prior to and for the subtraction, signal flow processor 20 utilizes a digital signal processor ("DSP") or comparable analog circuitry and corresponding software to provide an electrical time delay ($\tau$) to microphone element 22 (nearest the receiver of a handset or a headset, or the loudspeaker of a speakerphone, or other hands-free terminal) and a compatible amplitude gain (Gm1) to microphone element 24 (nearest the mouth).

Figure 2:
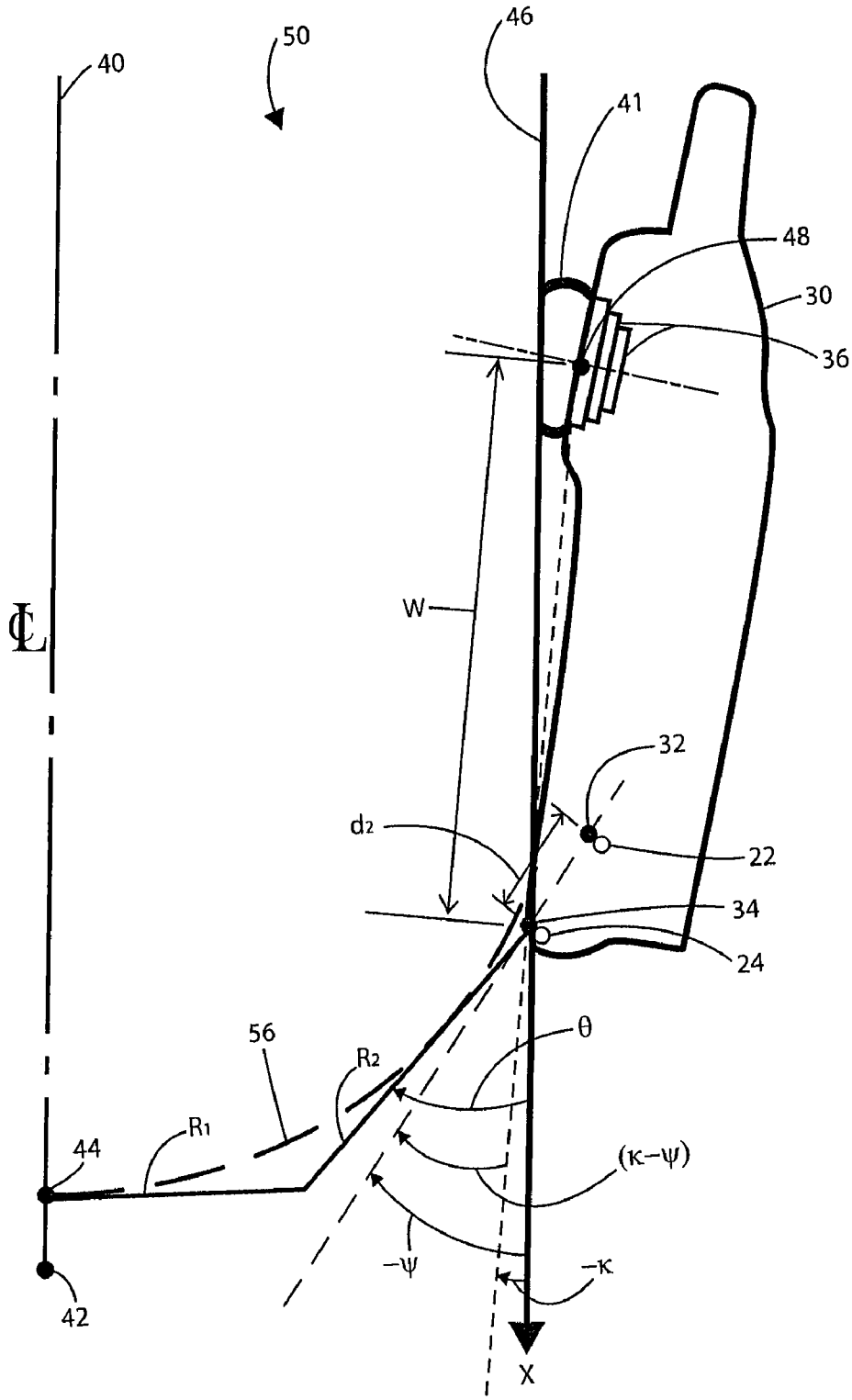
FIG. 2 shows a cellular phone schematically in relation to a user's head and that utilizes the exemplary embodiment of FIG. 1.

FIG. 2 shows an exemplary embodiment of a mobile phone that utilizes first-order gradient microphone system 15. As shown in FIG. 2, mobile phone 30 comprises a standard mobile phone design. Mobile phone 30 comprises a receiver (also known as an earpiece transducer) 36 and two microphone input sound ports 32 and 34. Sound port 32 leads into microphone element 22 and sound port 34 leads into microphone element 24. FIG. 2 illustrates both the position of a user's ear 41 and mouth 44 in relation to mobile phone 30. Line 40 represents the centerline of a head 50, wherein the line extends through mouth 44 and a mouth reference point 42. Thus, FIG. 2 shows half of the ear-mouth-ear plane. The position of mouth reference point 42 can vary but normally is 25 mm in front of the user's mouth 44. A side 46 of the user's head 50 and a cheek 56 indicate the position of the user's head relative to mobile phone 30.

Referring to FIG. 2, sound ports 32 and 34 and microphone elements 22 and 24 are each advantageously positioned with respect to the physical design of phone 30. Suitable microphone elements include, but are not limited to, two simple omnidirectional microphone elements, which are microphone elements that are equally sensitive to any acoustical wave coming from any incoming direction. The positions of sound ports 32 and 34 and microphone elements 22 and 24 will be specific to each embodiment of the phone and/or speakerphone housing in which the microphone system is used. Thus, the position of sound ports 32 and 34, as well as microphone elements 22 and 24, is not a limiting factor of the microphone system.

Still referring to FIG. 2, sound ports 32 and 34 are assumed to be positioned at an angle $\Psi$, which comprises the angle of sound port 34 and sound port 32 (i.e., angle $\Psi$ is defined by a line segment that passes through each of, and extends from sound ports 32 and 34, and a line segment X that passes through sound port 34 and extends from the side 46 of the user's head 50). An angle $\theta$ comprises the angle between line segment X and the effective mouth position of the user (i.e., angle $\theta$ is defined by line segment X and a line segment $R_2$ that passes and extends through sound port 34 and a point on user's cheek 56). Sound ports 32 and 34 are placed apart from one another at a distance of $d_2$. Ear reference point 48 is placed apart from sound port 34 at a distance w. This is the distance to the near field sound source. The distance w normally comprises a distance between about 25 mm and 200 mm. However, it should be realized that distance w is specific to each embodiment of the phone housing microphone system 15 and is not a limiting factor.

An Ear Reference Point ("ERP") 48 represents where the ear leaks are essentially located. ERP 48 is generally the point where the user's ear pinna plane meets the centerline of receiver 36. The effective distance between mouth and sound port 34 is represented by ($R_1$+$R_2$), where $R_1$ is tangent to cheek 56 and $R_2$ is perpendicular to centerline 40. The larger the distance ($R_1$+$R_2$) in the design of phone 30 is, the greater the need for room noise canceling will be. Angle $\kappa$ comprises the angle of ERP 48 and sound port 34 (i.e. angle $\kappa$ is defined by a line segment that passes through sound port 34 and ERP 48 and the line segment X).

Referring back to FIG. 1, when phone 30 is in either the receive state or in doubletalk state, signal flow processor 20 utilizes the digital signal processor to provide an advantageous electrical time delay ($\tau$) to microphone element 22 and a compatible and advantageous amplitude gain (Gm1) to microphone element 24. While microphone element 22 is closest to receiver 36 in this embodiment, either of identical microphone elements 22 or 24 can be in the closest position to receiver 36, so long as, the electrical time delay ($\tau$) is applied to the microphone element closest to receiver 36. Upon subtracting these two processed channels (microphone elements 22 and 24), the two-port, directional and 'noise-canceling' gradient microphone system 15 is obtained.

The combination of these elements (i.e., the processed microphone elements 22 and 24) creates a microphone system sensitivity having a near-field polar (directional) response containing a null (being axisymmetric about the line segment that extends through sound ports 32 and 34), that points towards the ear leaks. By pointing toward the ear leaks, the null greatly attenuates the pickup of ear leakage radiated toward the microphone system in spite of the close proximity of the microphone system. In other words, the subtraction of the two processed microphone elements results in a unitary microphone system having a null or dead spot/dead region with respect to audio waves received at a certain angle from the receiver of the communication device. The null in the microphone system significantly reduces the microphone reception and subsequent transmission of audio signals emitted through the ear leaks. Thus, this nulling process greatly reduces external acoustic coupling and, hence, in the receive and doubletalk states, echo during the call is prevented.

However, this near-field nulling process is not optimal in preventing far-end persons from hearing room noise as they listen (i.e., in the send or idle state of the mobile phone), because room noise is received by the microphone elements from all angles and from the far-field. To prevent ambient noise from interfering with the far-end person's ability to listen, and in contrast to the receive and doubletalk states, Gm1 is removed (i.e., Gm1 is set to unity) and $\tau$ is instead adjusted to optimize the attenuation of far-field ambient room noise pickup in the send and idle/quiet states.

With microphone elements 22 and 24 comprising two omnidirectional elements, signal flow processor 20 further uses a 'balancing' scheme that is known to those skilled in the art. The balancing scheme is run in the idle state to effectively match the electroacoustic sensitivities of the two omnidirectional elements. As a result of this balancing scheme, the two omnidirectional elements produce like input signals for processing in signal flow processor 20. This balancing scheme utilizes the ever present diffuse room noise as its acoustic input and employs a long averaging time. The balancing is constantly updated in the idle state, but should not change substantially over years of service.

Moreover, because gradient microphones are more sensitive to wind pickup than the traditionally used single port omnidirectional microphone systems, signal flow processor 20 senses when an uncommonly windy situation is present. It is noted that in handset applications a similar "puff" disturbance can come from the user's lips when the user pronounces, for example, "p" sounds. A puff disturbance causes the same problem as wind. When a windy or puff situation is present, signal flow processor 20, for send and possibly other states, switches to an omnidirectional microphone system comprising only microphone element 24, or, advantageously, the in-phase sum of both omni directional microphones 24 and 22.

Referring back to FIG. 1, signal flow processor 20 generally delays ($\tau$), amplifies (Gm1), and subtracts 26 the output of microphone elements 22 from 24 to form first-order gradient microphone system 15. Regardless of the customized pre-positioning of microphone elements 22 and 24 in the handset, signal flow processor 20 utilizes the digital signal processor to obtain transfer function $\tau$ in order to 'aim' a near-field polar directivity null toward the ear leakage when phone 30 is in the receive or doubletalk states. Moreover, microphone system 15 advantageously applies transfer function Gm1, so as to create and present a deep null toward the near-field incoming ear leakage sound. The angle at which the null needs to be aimed can be calculated based on the handset geometry. Referring to FIG. 2, the angle at which the null needs to be aimed is equal to $180°-(\kappa-\Psi)$. Angle $(\kappa-\Psi)$ is defined by the line segment that passes through sound ports 32 and 34 and the line segment that passes through ERP 48 and sound port 34. It will be appreciated that $(\kappa-\Psi)$ will remain the same regardless of the user's positioning of phone 30. In other words, while the size of angle $\kappa$ and angle $\Psi$ will both increase or decrease an equal amount, $(\kappa-\Psi)$ will always stay the same, regardless of how the user holds the phone in relation to side 46 of user's head 50 and cheek 56. It should also be noted that without application of Gm1, the null for near-field sound mitigation would not be deep.

Still referring to FIG. 2, a first-order approximation of the transfer functions $\tau$ and Gm1 are frequency independent and are estimated from the handset geometry and position of the microphone system parts. The first approximation of $\tau$ and Gm1 are given by the following formulas:

$$\tau=(w-u)/c;\ (u,w \text{ in millimeters}),\ \text{where } c=\text{speed of sound in air (at standard atmospheric temperature and pressure)}=345{,}000\ \text{mm/s, and } u=\sqrt{[w^2+d_2^2-2\,d_2\,w\cos(\kappa-\Psi)]}. \quad (1)$$

$$Gm1=(w/u). \quad (2)$$

However, because the geometry shown in FIG. 2 is a 2-D idealization of the actual 3-D handset physical structure, a more accurate, second order, approximation, which is frequency dependent, on $\tau$ and Gm1 is to drive the receiver 36 with an electrical impulse and measure the so called 'impulse response' (the output of the microphone elements) at both the locations of microphone elements 22 and 24. Then, the Fast Fourier Transform (FFT) of each impulse response (measured in the laboratory), when compared to one another by one skilled in the art, will yield (via the difference in the phase response at each frequency) and Gm1 (via the difference in the magnitude response at each frequency), both as functions of frequency, to be applied during the receive and doubletalk states. A special case of this second order approximation would be where and Gm1 are equal to (different) frequency-independent constants within a discrete number of so called "sub-bands" across the communication band of interest. The number of sub-bands can be any finite number of frequency bands that total the communication band of interest, which in this embodiment is 300 Hz to 3400 Hz. However, it should be realized that any band of frequencies can make up the communication band of interest.

Once the shape of the handset and the positions of sound ports 32 and 34 and the position of ear reference point 48 are fixed, the transfer functions can be determined using either the first-order or second-order approximation and should not generally need to be changed in the phone's service lifetime. To optimize room noise canceling when not in the receive or double talk state, Gm1 is set at unity (Gm1=1) and $\tau$ may be selected between 0 (bidirectional directivity) and a value '$d_2/c$' (unidirectional directivity) to yield the optimal far-field noise canceling system that best meets the needs of the particular communication device being fitted with microphone system 15.

A simulated performance analysis for microphone system 15 was performed on a typical mobile phone design. Referring to FIG. 2, the simulation began with the distance $d_2$ between sound ports 32 and 34 being a distance of about 7.6 millimeters and the angle $\Psi$ between sound port 34 and sound port 32 being an angle of about −50 degrees. In this exemplary embodiment, the distance w between ERP 48 and sound port 34 comprises approximately 80 millimeters and the angle $\kappa$ between ERP 48 to sound port 34 comprises approximately −7 degrees. Although not required to calculate $\tau$ and Gm1, the effective distance ($R_1+R_2$) between mouth 44 and sound port 34 comprises approximately 88 millimeters, and the angle $\theta$ comprises approximately −41 degrees. Based on the formulas, Gm1 is determined to be 1.072, $\tau$ is determined to be 15.6 μseconds and the angle at which the null needs to be aimed is determined to be 137 degrees, relative to the line segment that extends through sound ports 32 and 34, for this typical phone design. In this embodiment, the microphone system 15 can reduce echo at 1000 Hz by up to 20 dB as compared to other simple omnidirectional microphone systems. Moreover, simulation data shows that room noise can be attenuated by about 6 dB at 500 Hz relative to a simple omnidirectional microphone systems.

Figure 3:
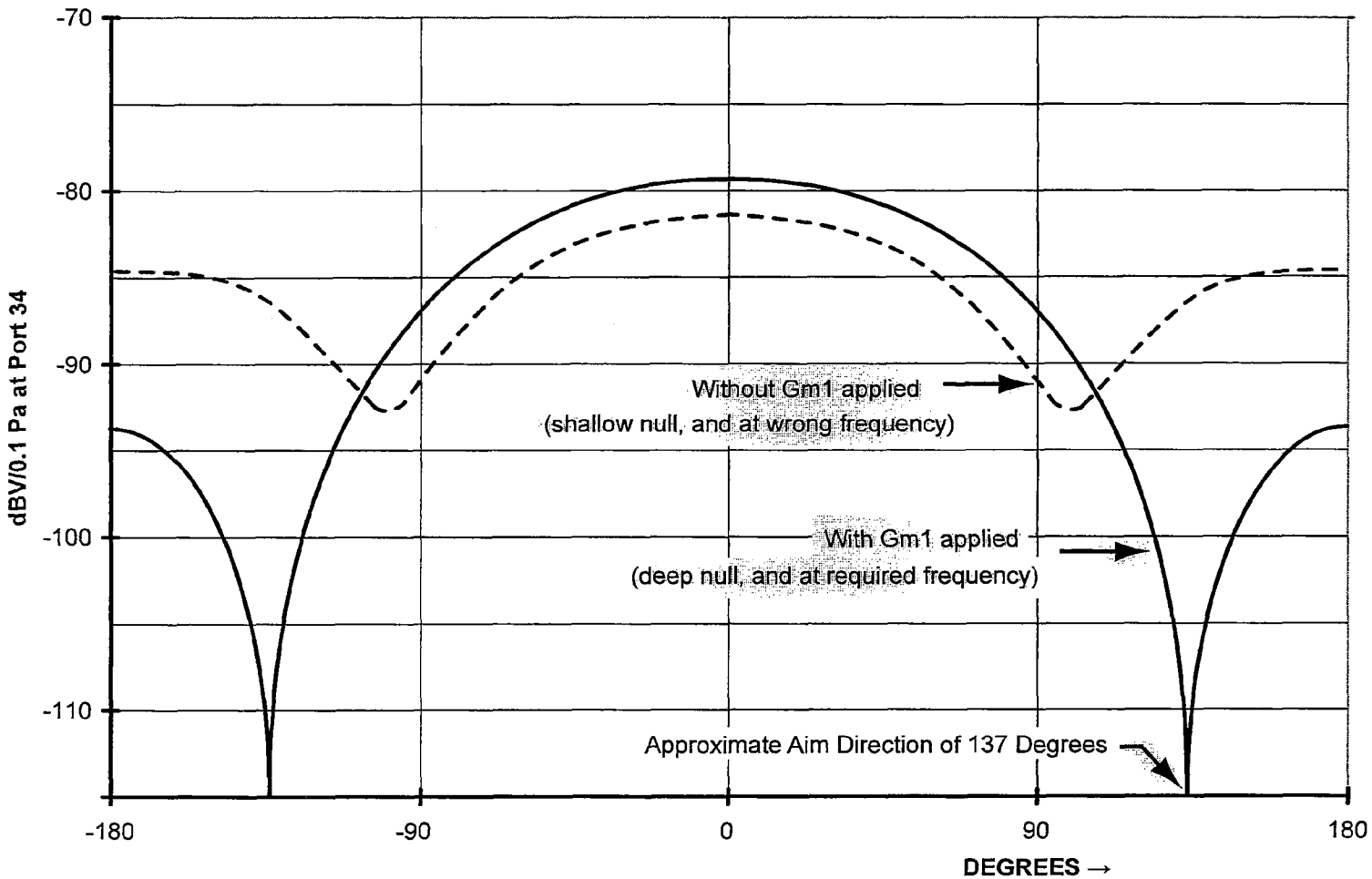
FIG. 3 shows the 500 Hz polar directivity response data for the exemplary embodiment displayed in FIG. 2, where notably w=80 mm.

FIG. 3 shows the near-field (from a distance of 80 mm) polar directivity response data (in decibels output from the microphone system at 500 Hz) for the microphone system utilized in mobile phone 30 with the angle $(\theta-(\kappa-\Psi))$ ranging from −180 to +180 degrees. As shown in FIG. 3, a simulation was run on mobile phone 30 to measure and compare the polar directivity response before and after the signal flow processor 20 applied Gm1, as specified above, for the receive and doubletalk states. Note that the near-field (where the distance from microphone element 34 to the near field sound source equals 80 mm (w=80 mm)) response null is very deep once Gm1 is applied and the null is located at approximately 137 degrees, the aim direction. This result is certainly uncommon, but very advantageous in reducing echo pickup.

Although not necessary, transfer functions Gm1 and τ can be advantageously modified for optimum noise canceling when exiting the receive or doubletalk states. The transfer functions, applicable for each state, are contemplated as being fixed (although possibly frequency dependent) for a given phone physical design (except insofar as the microphone element balancing updates during idle state and, temporarily, during a windy situation), but in principal they could adapt in real time to any changes during a telephone conversation, or over the phone's service life to avoid any possible deterioration in the microphone system's performance enhancement. Thus, microphone system 15 has utility to all handset-type and headset-type products, such as depicted in the exemplary embodiment of FIG. 2.

While the use of microphone system 15 in mobile phone 30 is described to demonstrate the benefits of such a microphone system for communication devices, the microphone system can be adapted to any physical design of a mobile phone or other types of land line or wireless hand held phone designs and any microphone placement therein (usually dictated by internal design constraints) to achieve the same echo and background noise reductions. Moreover, such a microphone system can be utilized in other communication devices such as hands-free headsets, desktop speakerphones and conference phones, hands-free automobile phone systems, and on-person communicators. In the case of the desktop speakerphones, conference phones and automotive products, the null of the microphone system is to be directed and adjusted advantageously toward the product's near-field loudspeaker which is the source of echo that can deteriorate full-duplex transmission.

Figure 4:
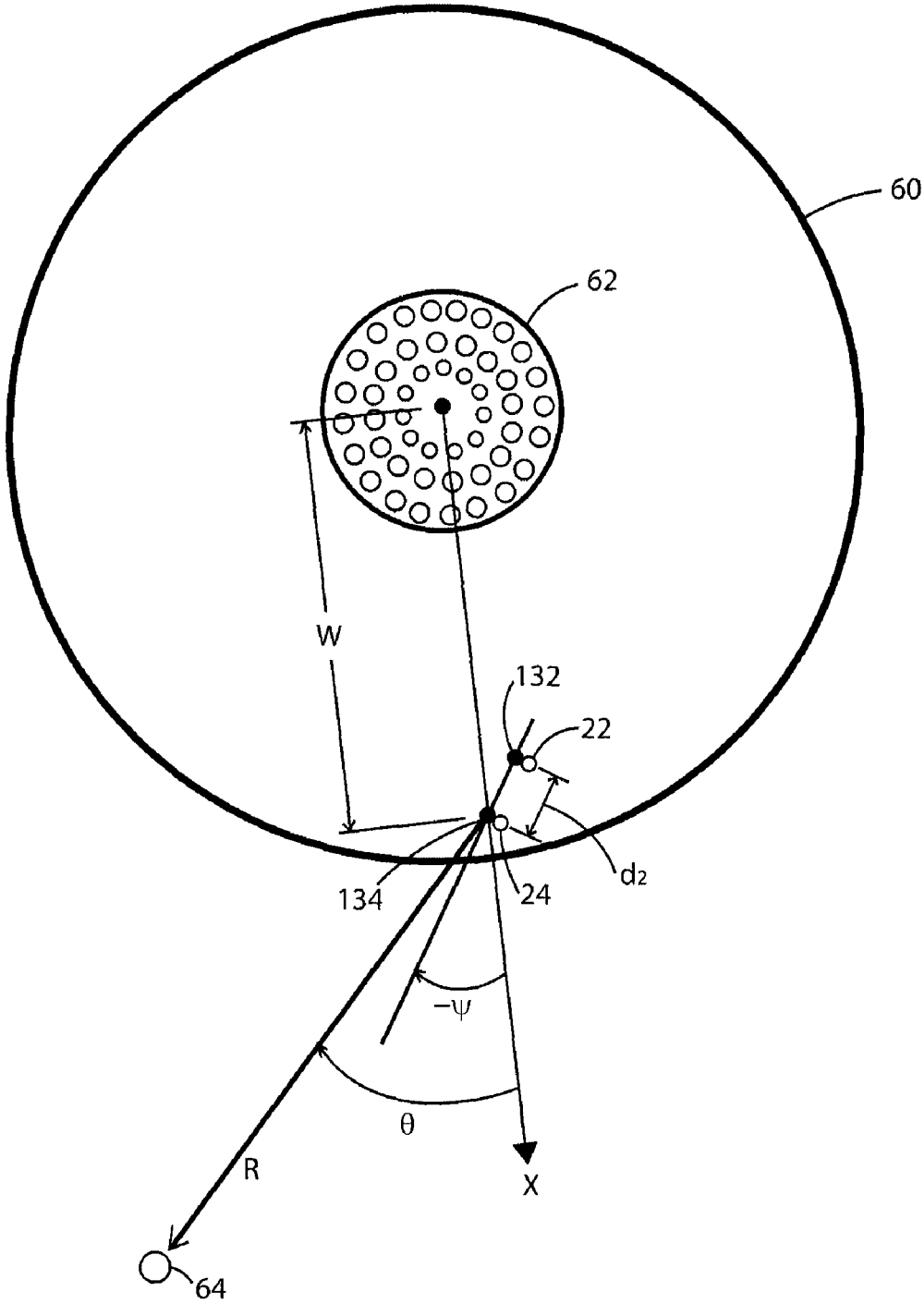
FIG. 4 shows a speaker phone that utilizes the exemplary embodiment of FIG. 1.

For example, FIG. 4 shows an exemplary embodiment of a speakerphone 60 that utilizes the first-order gradient microphone system 15. As can be seen in FIG. 4, speakerphone 60 has a loudspeaker or a loudspeaker sound grill 62 positioned in the center of the speakerphone. Speakerphone 60 also has two microphone input sound ports 132 and 134 positioned so that sound port 134 is a distance w away from the center of the loudspeaker and so that sound port 132 is closer to the loudspeaker than sound port 134. Sound port 132 leads into microphone element 22 of microphone system 15 and sound port 134 leads into microphone element 24. Similar to the mobile phone embodiment, sound ports 132 and 134 have distance $d_2$ between them. Further, sound port 134 is positioned at angle Ψ relative to sound port 132. A user 64 of the speaker phone is positioned at distance R and at angle θ from sound port 134.

The electrical time delay (τ) and the compatible amplitude gain (Gm1) for speakerphone 60 can be calculated in the same manner as τ and Gm1 were determined for the mobile phone. For example, the first approximation of τ and Gm1 can be calculated using the same formulas as described for the mobile phone. However, it should be noted that the speakerphone 60 does not have an ear reference point located adjacent to loudspeaker 62, and it is noted that line segment X emanates from the center of the loudspeaker and extends through sound port 134. Thus, angle κ between the ear reference point and sound port 134 equals zero identically and, thus, (κ−Ψ) equals −105 . Just as in the mobile phone, a more accurate and frequency dependent calculation of τ and Gm1 is to drive loudspeaker 62 with an electrical impulse and measure the so called 'impulse response' at both the outputs of microphone elements 22 and 24. The Fast Fourier Transform (FFT) of each response in the laboratory, when compared to one another by one skilled in the art, will yield τ (via the difference in the phase response) and Gm1 (difference in the magnitude response). Further, as described earlier, τ and Gm1 may also be held constant within sub-bands.

A simulated performance analysis for a speakerphone utilizing microphone system 15 was performed. Referring to FIG. 4, the simulation began with the distance $d_2$ from sound ports 132 and 134 being equal to about 16 millimeters and the angle Ψ of sound port 134 and sound port 132 being equal to identically zero degrees. It should be noted that in many designs, angle Ψ will not be zero. In this exemplary embodiment, the distance w from the center of loud speaker 64 and sound port 134 comprises approximately 114 millimeters. Although not required to calculate τ and Gm1, the diameter of loudspeaker 62 of speaker phone 60 is about 96 millimeters, the distance R from microphone element 134 to user 64 is greater than 500 millimeters and the angle θ is a variable angle defined by line segment R and line segment X. While the diameter of the speaker phone 60 is not required to calculate τ and Gm1, it does affect the amount of external acoustic coupling of the speakerphone. As already mentioned, the angle κ is equal to 0. Based on the formulas, Gm1 is determined to be 1.163, τ is determined to be 46.4 μseconds and the angle at which the null needs to be aimed is equal to 180 degrees for this speaker phone design.

Figure 5:
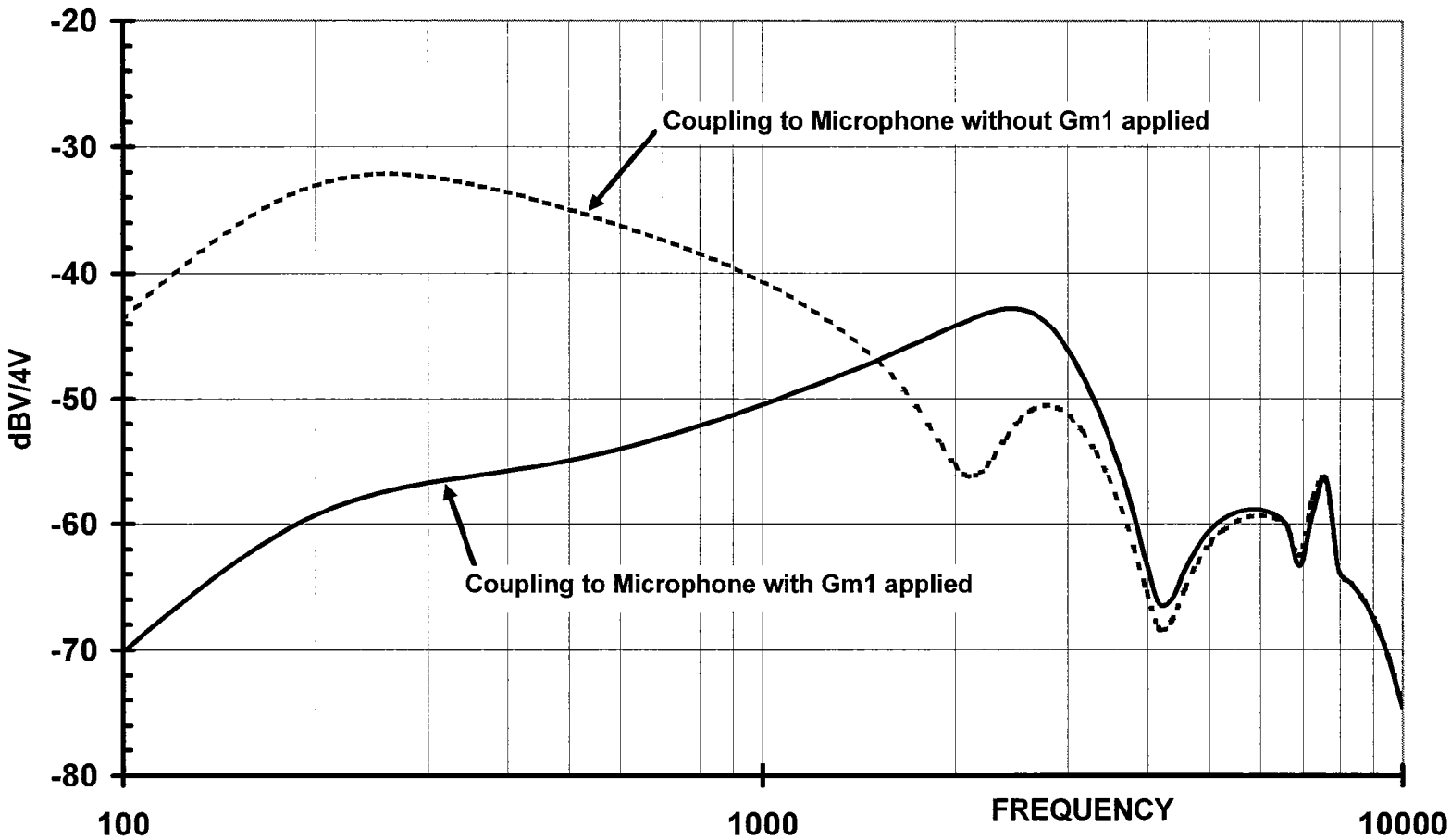
FIG. 5 shows the external acoustic coupling of the speakerphone of FIG. 4, with and without the amplitude gain being applied.

In this speakerphone embodiment, the microphone system 15 yields an improvement in the near-field polar response pickup similar to the improvement depicted in FIG. 3 in relation to mobile phone 30. Except in the case of speaker phone 60, the null will be directed toward the center of the loudspeaker/loudspeaker sound grill, which in this embodiment is an angle of 180 degrees. FIG. 5 shows the external acoustic coupling at the microphone system 15 output, in decibels relative to one volt, for speakerphone 60. As shown in FIG. 5, a simulation was run on speakerphone 60 to measure and compare the external acoustic coupling before and after the signal flow processor applied Gm1. The simulation used a 4 volt electrical sinusoidal swept signal to drive loudspeaker 62. As shown in FIG. 5, microphone system 15 reduces substantially external acoustic coupling and, thus, the transmission echo produced by the speakerphone. This reduction is especially evident over the traditional telephone band of 300 to 3400 Hertz.

Figure 6:
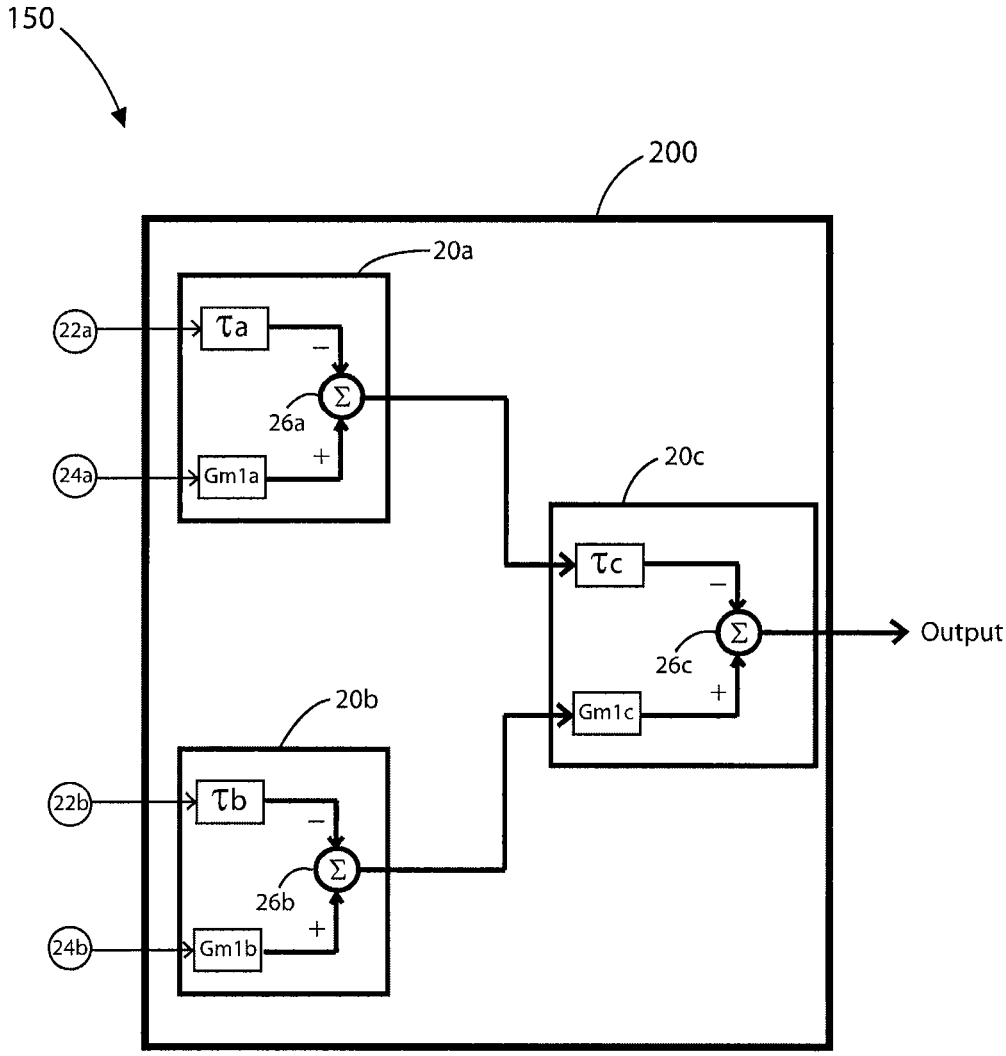
FIG. 6 shows an exemplary second-order gradient microphone system embodiment.

Many other embodiments of the invention exist. For example, FIG. 6 shows another embodiment of the microphone system for communication devices. As shown in FIG. 6, the microphone system comprises a second-order gradient microphone system 150 that can be used in any type of communication device. Here, three signal flow processors 20*a*, 20*b* and 20*c* are incorporated in combination to yield a higher order signal flow processor 200. Higher order signal flow processor 200 is electrically connected to four microphone elements 22*a* and 24*a* and 22*b* and 24*b*. Specifically, microphone elements 22*a* and 24*a* are electrically connected to signal flow processor 20*a* and eventually undergo a subtraction 26*a* to produce a first first-order difference. Microphone elements 22*b* and 24*b* are electrically connected to signal flow processor 20*b* and eventually undergo a subtraction 26*b* to produce a second first-order difference. Signal flow processors 20*a* and 20*b* are electrically connected to 20*c* and eventually undergo a subtraction 26*c* to produce a second-order difference. Second-order gradient microphone system 150 can yield a higher attenuation of acoustical coupling and lower pickup of ambient noise.

Microphone elements 22*a* and 24*a* and 22*b* and 24*b* can be placed in any communication device and each will have a separate and distinct microphone sound port 32*a* and 34*a* and 32*b* and 34*b* (not pictured) that will lead into each of the microphone elements, respectively. The electrical time delays ($\tau_a$ and $\tau_b$, respectively) for microphone elements 22*a* and 22*b* and the compatible amplitude gain (Gm1$_a$ and Gm1$_b$, respectively) for microphone elements 24*a* and 24*b* can be calculated using the same formulas and variables as described and defined in the above embodiments. While signal flow processor 20*c* does not actually have physical microphone elements or sound ports connected to it, the same formulas and variables can be applied to its virtual microphone element/port positions. The first virtual microphone element/sound port position will be halfway between the sound ports that lead into microphone elements 22*a* and 24*a* and the second virtual microphone element/sound port position will be halfway between the sound pound ports that lead into microphone elements 22*b* and 24*b*. Alternatively, a frequency dependent calculation of electrical time delays ($\tau_a$, $\tau_b$, and $\tau_c$) and compatible amplitude gains (Gm1$_a$, Gm1$_b$, and Gm1$_c$) can be determined by driving the loudspeaker or receiver with an electrical impulse and measuring the impulse response of each of the microphone elements 22*a*, 24*a*, 22*b* and 24*b*.

The second-order gradient microphone system can comprise any number of microphone elements and is not limited to four microphone elements as disclosed in FIG. 6. For example, one skilled in the art realizes that microphone elements 22*b* and 24*a* can be a single microphone element that is electrically connected to both signal flow processors 20*a* and 20*b*.

While embodiments of the subject invention have been described in considerable detail, such is offered by way of non-limiting examples of the invention as many other versions are possible. For example, this technology could be applied to hands-free communication devices where the loudspeaker and microphones are physically separated, or to communication devices where the microphone ports are not largely in the same plane with the receiver or loudspeaker center. Further, more than one of these microphone systems can be utilized in a communication device. It is anticipated that a variety of other modifications and changes will be apparent to those having ordinary skill in the art and that such modifications and changes are intended to be encompassed within the spirit and scope of the invention as defined by any later appended claims.

We claim:

1. A microphone system for communication devices comprising:

a. a first input sound port that leads into a first omnidirectional microphone element;

b. a second input microphone port that leads into a second omnidirectional microphone element positioned near the first microphone element; and c. a signal flow processor electrically connected to the first and second microphone elements;

wherein the signal flow processor provides an electrical time delay ("$\tau$") only to the first microphone element and provides a compatible amplitude gain to the second microphone element;

wherein $\tau=(w-u)/c$, the variable "w" equals the distance between the receiver and the second sound port, the variable "c" equals approximately 345,000 millimeters per second, and the variable "u" equals $\sqrt{[w^2+d_2^2-2\,d_2\,w\cos(\kappa-\Psi)]}$ with the variable "$d_2$" being equal to the distance between the first and second input sound ports, with the variable "$\kappa$" being equal to the angle of an ear reference point adjacent to the receiver and the second input sound port, and with the variable "$\Psi$" being equal to the angle of the first input sound port and the second input sound port; and wherein the signal flow processor subtracts the outputs of the first and second microphone elements to create a null that reduces external acoustic coupling.

2. The microphone system of claim 1, wherein the first and second input sound ports each comprise a sound input port of a mobile phone.

3. The microphone system of claim 2, wherein the mobile phone comprises a receiver positioned and located closer to the first input sound port than the second input sound port.

4. The microphone system of claim 3, wherein the signal flow processor makes the amplitude gain equal to unity.

5. The microphone system of claim 1, wherein the compatible amplitude gain ("Gm1") is equal to Gm1=(w/u).

6. The microphone system of claim 1, wherein the first and second input sound ports each comprise an input sound port of a speakerphone, wherein the speakerphone comprises a loudspeaker with its center located and positioned closer to the first input sound port than the second input sound port.

7. The microphone system of claim 6, wherein the signal flow processor makes the amplitude gain equal to unity.

8. The microphone system of claim 6, wherein compatible amplitude gain ("Gm1") is equal to Gm1=(w/u).

9. A method for producing a null towards an acoustical driver of a communication device for reducing external acoustic coupling in the communication device, the method comprising the steps of:

providing a microphone system for telecommunications having (i) a first input sound port that leads into a first omnidirectional microphone element having a first output; and (ii) a second input microphone port that leads into a second omnidirectional microphone element positioned near the first microphone element, the second microphone element having a second output;

(iii) a signal flow processor electrically connected to the first and the second microphone elements;

utilizing the signal flow processor to provide an electrical time delay ("$\tau$") to the first output, wherein $\tau=(w-u)/c$, the variable "w" equals the distance between the receiver and the second sound port, the variable "c" equals approximately 345,000 millimeters per second, and the variable "u" equals $\sqrt{[w^2+d_2^2-2\,d_2\,w\cos(\kappa-\Psi)]}$ with the variable "$d_2$" being equal to the distance between the first and second input sound ports, with the variable "$\kappa$" being equal to the angle of an ear reference point adjacent to the receiver and the second input sound port, and with the variable "$\Psi$" being equal to the angle of the first input sound port and the second input sound port;

utilizing the signal flow processor to provide an amplitude gain to the second output; and utilizing the signal flow process to subtract the first output from the second output to create a null that reduces external acoustic coupling.

10. The method of producing the null of claim 9, wherein the acoustical driver comprises a receiver positioned and located closer to the first input sound port than the second input sound port.

11. The method of producing the null of claim 9, wherein the method further comprises the step of calculating the compatible amplitude gain ("Gm1") with the formula Gm1=(w/u).

12. The method of producing the null of claim 9, wherein the first and second input sound ports each comprise an input sound port of a speakerphone and wherein the acoustical driver comprises a loudspeaker positioned and located closer to the first input sound port than the second input sound port.

13. The method of producing the null of claim 12, wherein the method further comprises the step of calculating the compatible amplitude gain ("Gm1") with the formula Gm1=(w/u).

14. The method of producing the null of claim 10, wherein the electric time delay and compatible amplitude gain are each equal to a constant value with a finite number of discrete sub-bands across the communications band.

15. The method of producing the null of claim 12, wherein the electric time delay and compatible amplitude gain are each equal to a constant value within a finite number of discrete sub-bands across the communications band.

* * * * *